US011757227B2

(12) United States Patent
Ikeda

(10) Patent No.: US 11,757,227 B2
(45) Date of Patent: Sep. 12, 2023

(54) CONNECTOR HAVING REAR HOLDER

(71) Applicant: SUMITOMO WIRING SYSTEMS, LTD., Mie (JP)

(72) Inventor: Atsuya Ikeda, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 19 days.

(21) Appl. No.: 17/535,630

(22) Filed: Nov. 25, 2021

(65) Prior Publication Data

US 2022/0190508 A1 Jun. 16, 2022

(30) Foreign Application Priority Data

Dec. 11, 2020 (JP) ..... 2020-205648

(51) Int. Cl.
*H01R 13/639* (2006.01)
*H01R 13/518* (2006.01)
*H01R 13/52* (2006.01)

(52) U.S. Cl.
CPC ..... *H01R 13/518* (2013.01); *H01R 13/5213* (2013.01); *H01R 13/639* (2013.01)

(58) Field of Classification Search
CPC ..... H01R 13/518; H01R 13/5213; H01R 13/639; H01R 13/506
See application file for complete search history.

(56) References Cited

U.S. PATENT DOCUMENTS 8,366,473 B2 * 2/2013 Kataoka ..... H01R 13/5208 439/350
10,944,187 B2 3/2021 Takeuchi et al.
2019/0252803 A1 * 8/2019 Takeuchi ..... H01R 13/424

FOREIGN PATENT DOCUMENTS

JP 2020-074346 A 5/2020
WO WO-2019178434 A1 * 9/2019 ..... H01R 13/506

* cited by examiner

*Primary Examiner* — Tho D Ta
(74) *Attorney, Agent, or Firm* — Venjuris, P.C.

(57) ABSTRACT

A housing includes a plurality of cavities arranged in a width direction and housing-side engaging portions provided on both end sides in the width direction. A rear holder includes a plurality of insertion holes arranged in the width direction and communicating with the cavities, and holder-side engaging portions provided on both end sides in the width direction to contact the housing-side engaging portions. Terminals are connected to wires arranged from the insertion holes to the cavities. The housing-side engaging portions are arranged to cover the holder-side engaging portions from outside. A guide receiving portion extending in a front-rear direction is provided on an inner surface of the housing-side engaging portion. A guide portion extending in the front-rear direction and to be fit to the guide receiving portion is provided on an outer surface of the holder-side engaging portion.

4 Claims, 12 Drawing Sheets

CONNECTOR HAVING REAR HOLDER

CROSS-REFERENCE TO RELATED APPLICATIONS

This application is based on and claims priority from Japanese Patent Application No. 2020-205648, filed on Dec. 11, 2020, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2019-145208 includes a housing and a rear holder to be arranged on a rear part of the housing. The housing includes a plurality of cavities. A terminal is accommodated into each cavity. The rear holder includes a plurality of insertion holes communicating with the respective cavities. A wire is inserted into the insertion hole of the rear holder. A tip part of the wire is located in the cavity and connected to the terminal. A similar connector is also disclosed in Japanese Patent Laid-open Publication No. 2020-074346.

SUMMARY

If the cavities and the insertion holes are not coaxially arranged in a front-rear direction and are displaced in a direction (height direction, width direction) intersecting the front-rear direction and their displacement amounts are large, the tip parts of the wires interfere with end edges of the terminals or the like and cannot reach positions where the tip parts are connectable to the terminals. As a result, a problem of interrupting a connector assembling operation occurs.

Accordingly, the present disclosure aims to provide a connector which can be efficiently assembled.

The present disclosure is directed to a connector with a housing, a rear holder to be arranged on a rear part of the housing, and terminals to be accommodated into the housing, wherein the housing includes a plurality of cavities arranged in a width direction and housing-side engaging portions provided on both end sides in the width direction, the rear holder includes a plurality of insertion holes arranged in the width direction and communicating with the cavities and holder-side engaging portions provided on both end sides in the width direction to contact the housing-side engaging portions, the terminals are connected to wires arranged from the insertion holes to the cavities, one of the housing-side engaging portion and the holder-side engaging portion is arranged to cover the other from outside, and a guide receiving portion extending in a front-rear direction is provided on an inner surface of the one engaging portion and a guide portion extending in the front-rear direction and to be fit to the guide receiving portion is provided on an outer surface of the other engaging portion.

According to the present disclosure, it is possible to provide a connector which can be efficiently assembled.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
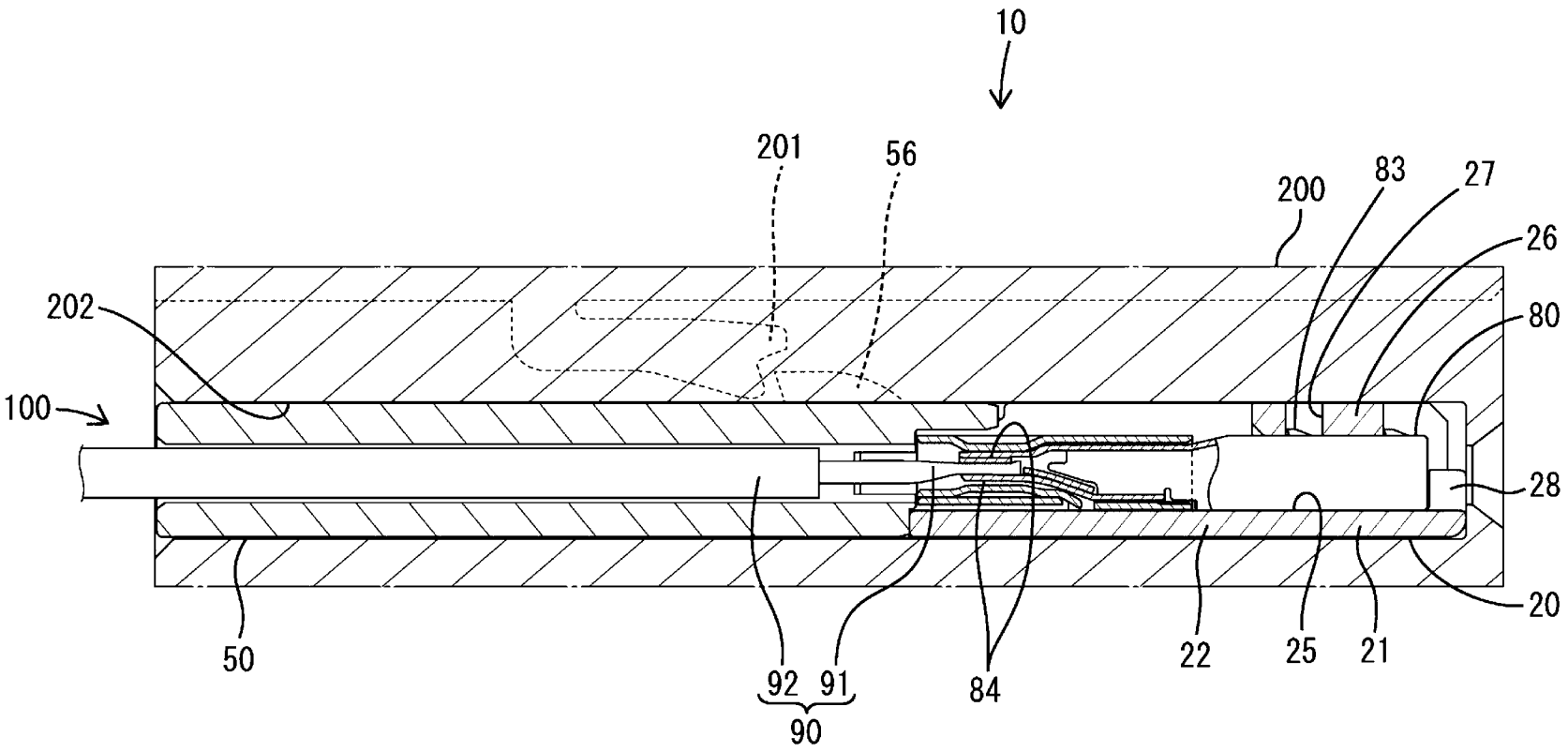
FIG. 1 is a side view in section showing a state where a subunit is accommodated in a main housing in a connector according to a first embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes a housing, a rear holder to be arranged on a rear part of the housing, and terminals to be accommodated into the housing, wherein the housing includes a plurality of cavities arranged in a width direction and housing-side engaging portions provided on both end sides in the width direction, the rear holder includes a plurality of insertion holes arranged in the width direction and communicating with the cavities and holder-side engaging portions provided on both end sides in the width direction to contact the housing-side engaging portions, the terminals are connected to wires arranged from the insertion holes to the cavities, one of the housing-side engaging portion and the holder-side engaging portion is arranged to cover the other from outside, and a guide receiving portion extending in a front-rear direction is provided on an inner surface of the one engaging portion and a guide portion extending in the front-rear direction and to be fit to the guide receiving portion is provided on an outer surface of the other engaging portion.

By fitting the guide portion and the guide receiving portion, the insertion holes and the cavities can be allowed to accurately communicate. As a result, relative displacements of the wires and the terminals can be suppressed and the connector can be efficiently assembled.

(2) Preferably, the housing has side walls on both end sides in the width direction and the housing-side engaging portion serving as the one engaging portion includes a projecting portion projecting rearward from the side wall, and the rear holder has side surfaces on both end sides in the width direction and the holder-side engaging portion serving as the other engaging portion includes a recess open forward to receive the housing-side engaging portion in the side surface.

The housing-side engaging portion can be provided with the projecting portion with an increase in the width of the housing suppressed by utilizing the side wall of the housing. Further, since the holder-side engaging portion also includes the recess in the side surface of the rear holder, an increase in the width of the rear holder is not caused. As a result, the enlargement of the entire connector in the width direction can be suppressed.

(3) A lock receiving portion may be provided on an inner surface of the projecting portion and a lock portion to be locked to the lock receiving portion may be provided on an inner surface of the recess, the projecting portion may be deflectable and deformable with a fulcrum portion as a fulcrum, and the guide receiving portion and the guide portion may be fit to configure a front fitting region forward of the fulcrum portion.

The projecting portion of the housing-engaging portion and the recess of the holder-side engaging portion are provided with a locking structure composed of the lock receiving portion and the lock portion in addition to a guiding structure composed of the guide portion and the guide receiving portion. Thus, the structure of the connector can be simplified as compared to the case where the guiding structure and the locking structure are provided in separate locations.

On the other hand, if the projecting portion is deflected and deformed with the fulcrum portion as a fulcrum, the guide portion and the guide receiving portion may be disengaged. However, according to the above configuration, the fitting of the guide portion and the guide receiving portion can be maintained by the front fitting region forward of the fulcrum portion.

(4) The guide receiving portion may be in the form of a groove recessed in the inner surface of the one engaging portion and having a back end side enlarged in a height direction, and the guide portion may be in the form of a projection projecting from the outer surface of the other engaging portion and having a tip side enlarged in the height direction.

By fitting the guide portion and the guide receiving portion shaped as described above, the insertion holes and the cavities can be allowed to accurately communicate.

(5) The housing may include partition walls partitioning between the cavities adjacent in the width direction and the rear holder may include a covering wall for covering rear openings of the cavities at positions facing end parts of the partition walls, and the covering wall may include recesses to be fit to the end parts of the partition walls.

By fitting the end parts of the partition walls into the recesses, relative displacements of the covering wall and the partition walls can be suppressed and a displacement suppressing function by the guide portion and the guide receiving portion can be complemented.

Details of Embodiments of Present Disclosure

Specific examples of connectors according to embodiments of the present disclosure are described below with reference to the drawings. Note that the present invention is not limited to these illustrations and is intended to be represented by claims and include all changes in the scope of claims and in the meaning and scope of equivalents.

First Embodiment

A connector 10 according to a first embodiment includes, as shown in FIG. 1, a housing 20, a rear holder 50 and terminals 80. The housing 20 and the rear holder 50 are assembled with each other to configure a subunit 100. The subunit 100 is accommodated into a main housing 200. The main housing 200 is connectable to an unillustrated mating housing. In the following description, a side to be connected to a mating connector is referred to as a front side concerning a front-rear direction. A right side of FIG. 1 is a front side. A vertical direction is based on a vertical direction of FIG. 1 and may be called a height direction. A lateral direction is based on a direction perpendicular to the plane of FIG. 1 and may be called a width direction. These directions are merely set as references for convenience and do not limit an actual use mode.

<Housing>

Figure 3:
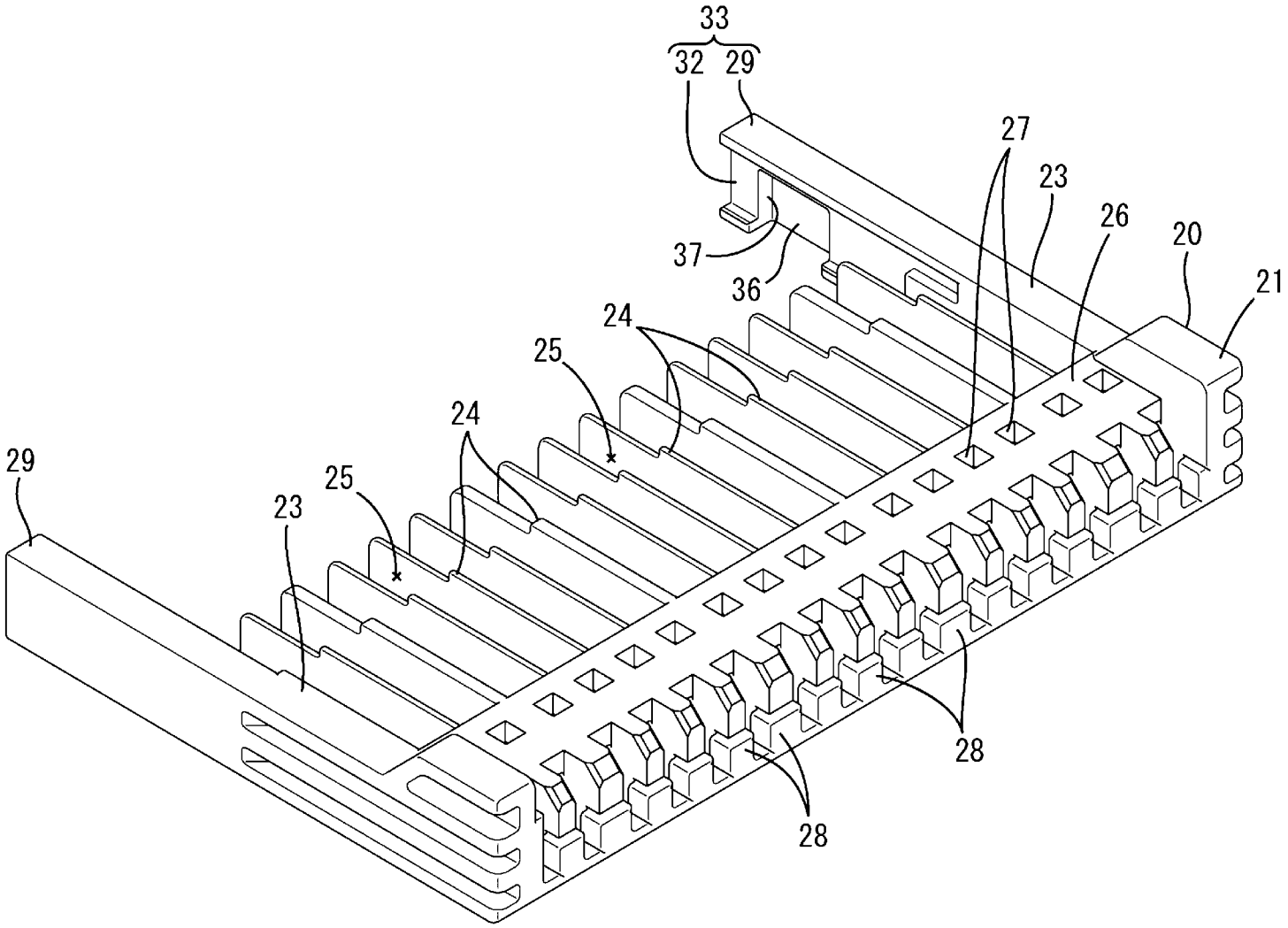
FIG. 3 is a perspective view of a housing.

The housing 20 is made of synthetic resin and includes, as shown in FIG. 3, a flat housing body 21 long in the width direction. The housing body 21 includes a bottom wall 22 (see FIG. 1) in the form of a rectangular plate, a pair of side walls 23 rising from both widthwise ends of the bottom wall 22 and a plurality of partition walls 24 located between the respective side walls 23 and rising from the upper surface of the bottom wall 22. The respective partition walls 24 and side walls 23 are in the form of rectangular plates long in the front-rear direction. A plate thickness (width) of the side wall 23 is larger than that of the partition wall 24. The respective partition walls 24 are arranged at fixed intervals in the width direction on the upper surface of the bottom wall 22.

The housing body 21 includes a plurality of cavities 25 arranged in the width direction between the partition walls 24 located on both widthwise ends and the side walls 23 and between adjacent ones of the respective partition walls 24. The upper ends of the side walls 23 and those of the respective partition walls 24 are coupled by a bridge portion 26 in a front part of the housing body 21. The bridge portion 26 is formed over the entire width of the housing body 21. The bridge portion 26 is provided with locking holes 27 having a rectangular opening at positions corresponding to the respective cavities 25. The respective cavities 25 are open upward except at the bridge portion 26.

The housing body 21 includes contact walls 28 at positions corresponding to the respective cavities 25 on the front end of the bottom wall 22. A front surface opening of each cavity 25 is partially closed by the contact wall 28. The terminal 80 is inserted into the cavity 25 of the housing body 21. A forward movement of the terminal fitting 80 beyond a proper insertion position is restricted by the contact of the terminal fitting 80 with the contact wall 28. Further, a rearward movement of the terminal 80 beyond the proper insertion position is restricted by fitting a later-described locking portion 83 into the locking hole 27.

Further, the housing 20 includes a pair of projecting portions 29 projecting rearward from the respective side walls 23 on both widthwise end sides of the housing body 21. The projecting portion 29 is in the form of a plate continuous from the side wall 23 and has the same height as the side wall 23. The projecting portion 29 includes a fulcrum portion 31 (see FIGS. 5 and 7) at an intermediate position in the front-rear direction. The projecting portion 29 is deflectable and deformable in the width direction with the fulcrum portion 31 as a fulcrum.

The respective projecting portions 29 include concave guide receiving portions 32 in inner surfaces facing each other. As shown in FIG. 3, the guide receiving portion 32 extends in the front-rear direction and is open in the rear end of the projecting portion 29. The guide receiving portion 32 is also provided to be continuous with the inner surface side of the side wall 23 and has a closing end on the inner surface of the side wall 23. The projecting portion 29 and the guide receiving portion 32 constitute a housing-side engaging portion 33.

Figure 10:
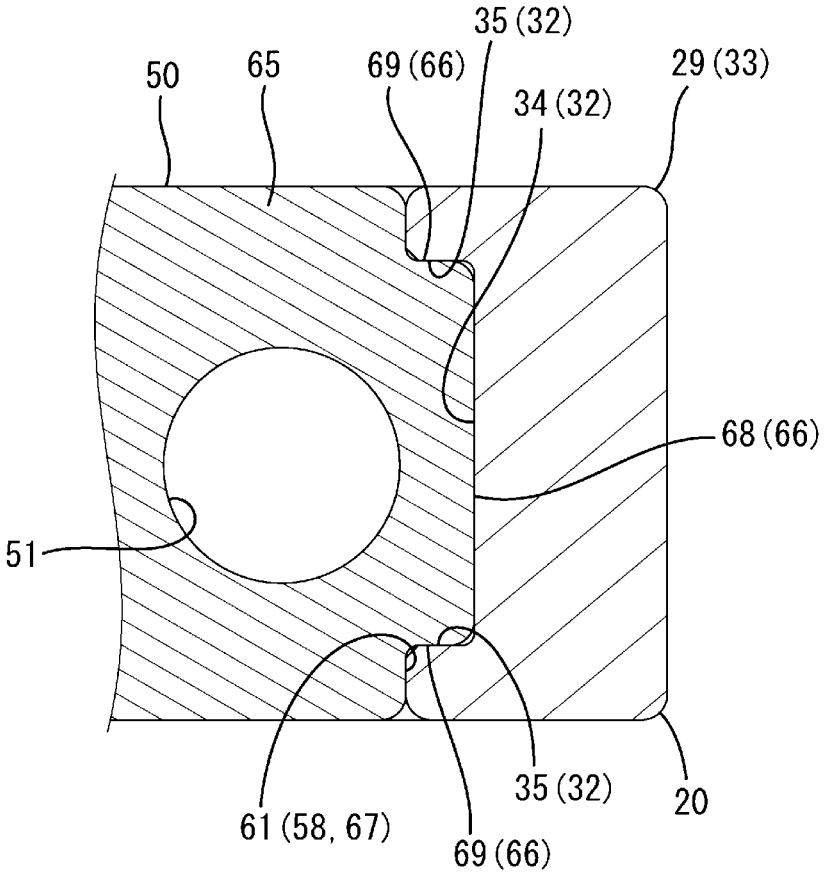
FIG. 10 is a partial enlarged transverse section showing the state where a guide receiving portion of the projecting portion and a guide portion of a body portion are fit.

As shown in FIG. 10, the guide receiving portion 32 has a concave wall surface 34 arranged along the vertical direction and front-rear direction on a back side in a concave direction in a part of the inner surface of the projecting portion 29 except both upper and lower end parts, and has a pair of concave side surfaces 35 arranged along the lateral direction and front-rear direction on both end sides in the height direction.

Figure 11:
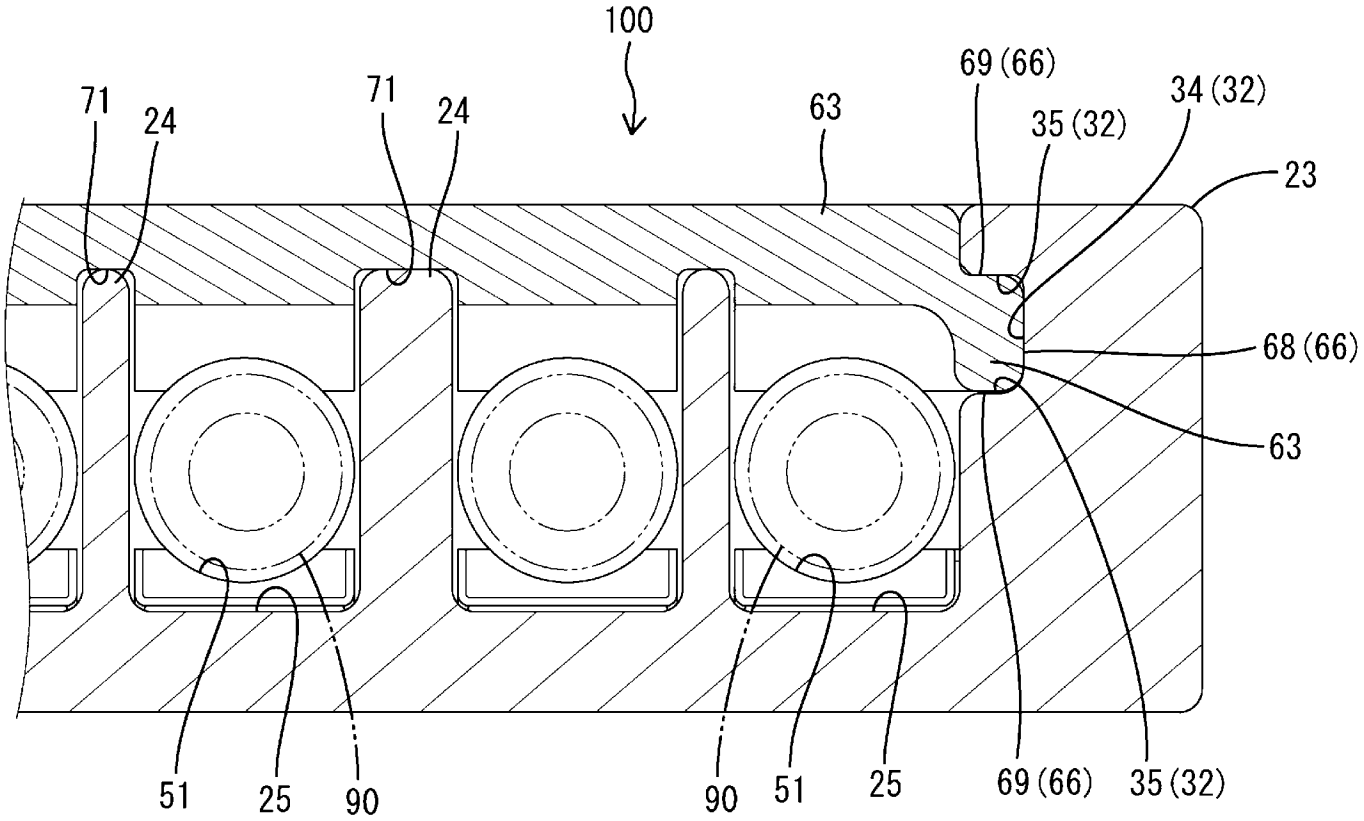
FIG. 11 is a partial enlarged transverse section showing a state where a guide receiving portion of a side wall and a guide portion of a covering wall are fit.

As shown in FIG. 11, a concave wall surface 34 of the side wall 23 is connected to an upper end part of the concave wall surface 34 of the projecting portion 29 without any step. Similarly, an upper concave side surface 35 of the side wall 23 is connected to the upper concave side surface 35 of the projecting portion 29 without any step. A lower concave side surface 35 of the side wall 23 is arranged above the lower concave side surface 35 of the projecting portion 29.

Figure 9:
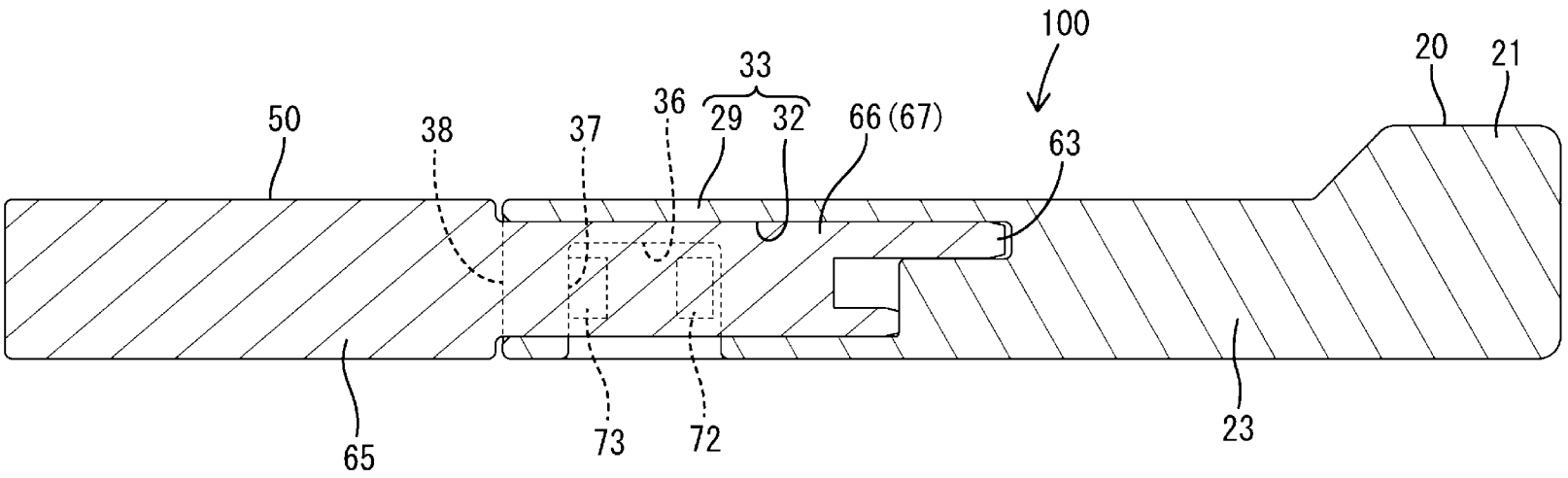
FIG. 9 is a side view in section entirely showing a state where the guide portion and the guide receiving portion are fit.

As shown in FIG. 3, each projecting portion 29 includes a concave lock receiving portion 36 in the concave wall surface 34 thereof. The lock receiving portion 36 has a rectangular outer shape when viewed from a direction facing the inner surface of the projecting portion 29 and is open in the lower end of the projecting portion 29 and closed by an outer surface side of the projecting portion 29. The rear edge of the lock receiving portion 36 is configured as a retaining edge 37 along the vertical direction. As shown in FIG. 9, the rear holder 50 is locked to the retaining edges 37 while being held in the housing 20, whereby the escape of the rear holder 50 from the housing 20 is restricted. Further, the rear end of the projecting portion 29 is configured as a restricting edge 38 for restricting a movement of the rear holder 50 from a full locking position to a partial locking position to be described later.

<Rear Holder>

Figure 4:
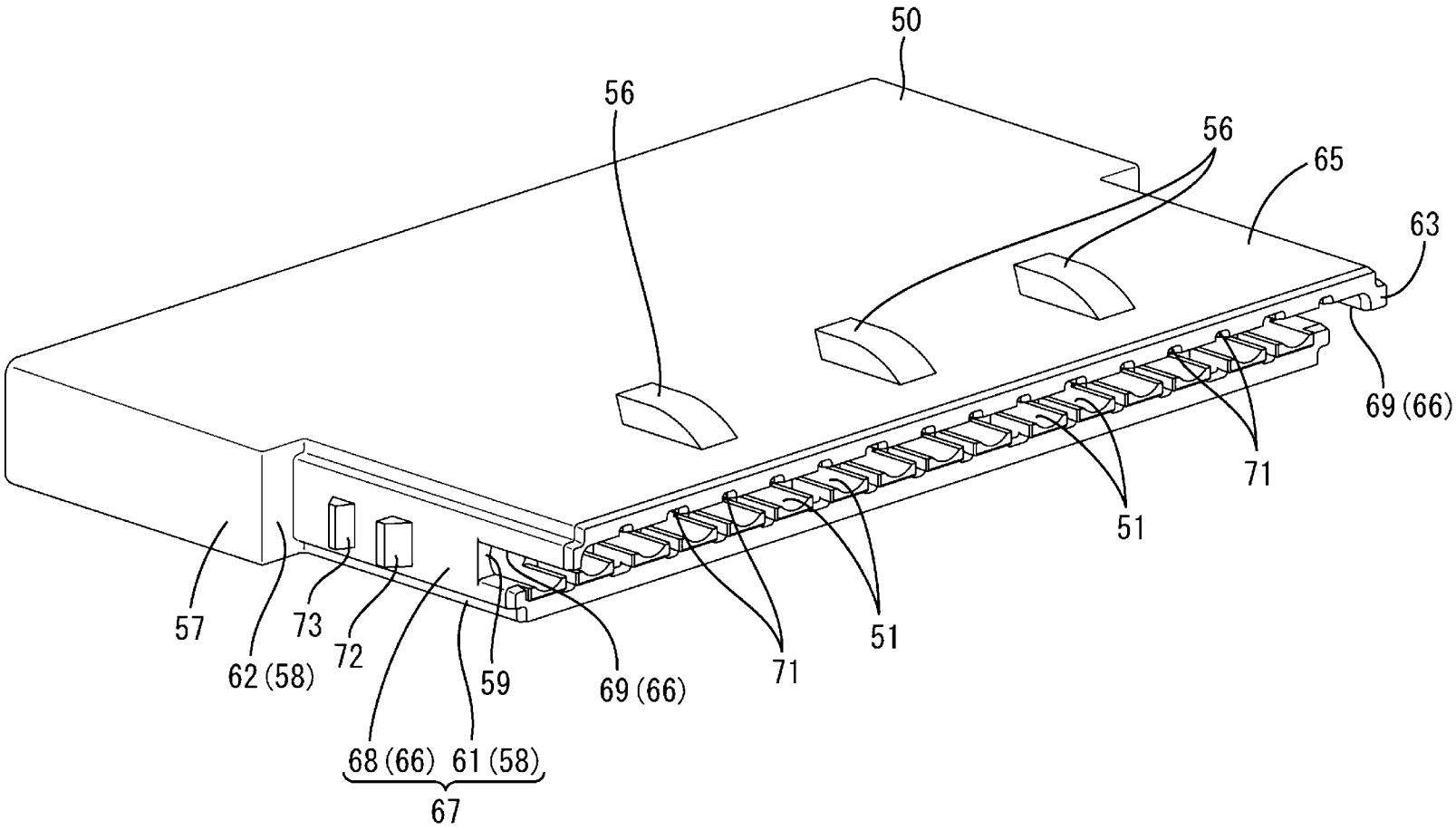
FIG. 4 is a perspective view of a rear holder.

The rear holder 50 is made of synthetic resin and, as shown in FIG. 4, has a flat shape long in the width direction as a whole. The rear holder 50 has a rectangular outer shape in a plan view and a bottom view. The rear holder 50 includes a plurality of insertion holes 51 which communicate with the respective cavities 25 in the front-rear direction. Each insertion hole 51 has a circular cross-section and has such an opening diameter that the terminal 80 is insertable thereinto. As shown in FIG. 4, a plurality of lock projections 56 arranged in the width direction are provided on a front part of the upper surface of the rear holder 50. As shown in FIG. 1, the lock projections 56 are locked to locking lances 201 provided in the main housing 200.

Figure 8:
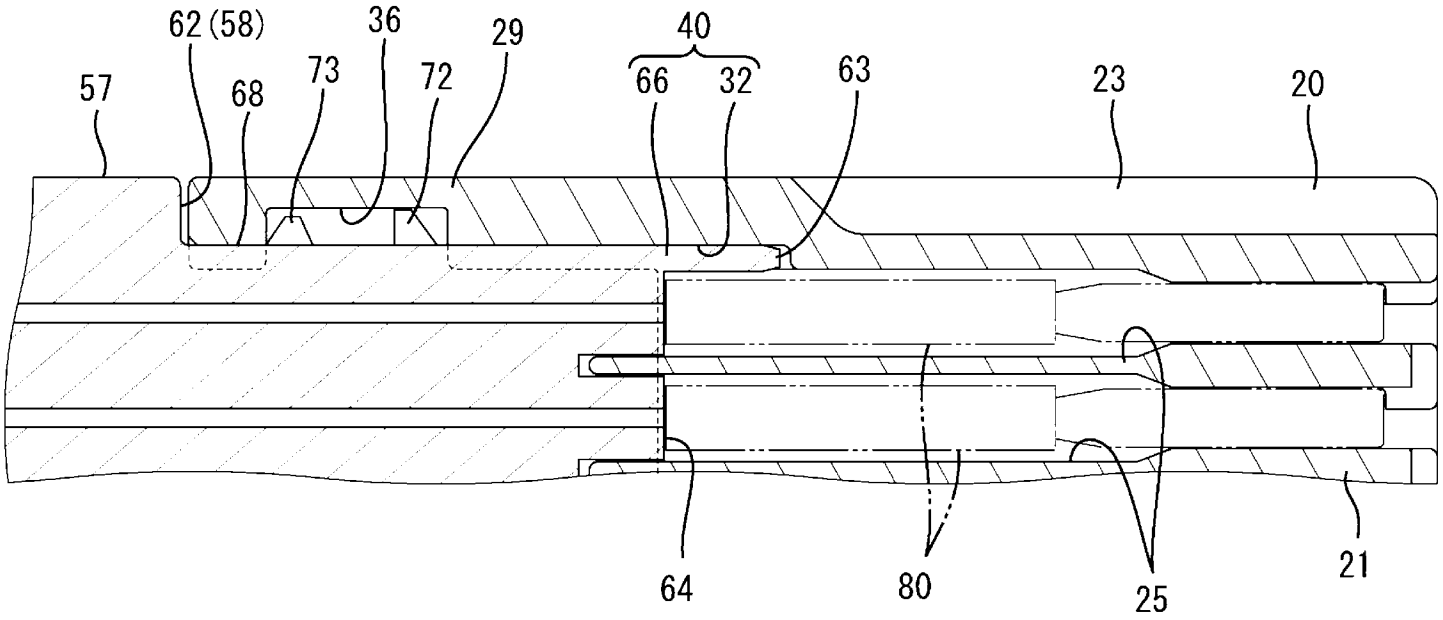
FIG. 8 is a partial enlarged plan view in section showing a state where the rear holder reaches the full locking position, the projecting portion resiliently returns and a lock receiving portion and a lock portion are locked.

The rear holder 50 has a pair of side surfaces 57 (only one is shown in FIG. 4) on both widthwise end sides. Each side surface 57 has a recess 58 in a front part. As shown in FIG. 4, the recess 58 has an inner surface 61 arranged along the vertical direction and front-rear direction and a step surface 62 connected to the rear end of the inner surface 61 and arranged along the vertical direction and lateral direction. As shown in FIG. 8, a lateral dimension of the step surface 62 is equal to or larger than a plate thickness of the projecting portion 29. The projecting portion 29 is fit into the recess 58 to cover the inner surface 61 from outside.

As shown in FIG. 4, a front end part of the rear holder 50 is provided with a cut portion 59 penetrating through the inner surfaces 61 of the recesses 58 and the respective insertion holes 51. The cut portion 59 is in the form of a rectangular recess in a side view and open in the front surface of the rear holder 50. The front end part of the rear holder 50 includes a covering wall 63 on an upper wall, out of walls vertically facing each other across the cut portion 59. The covering wall 63 projects forward from a body portion 65 of the rear holder 50.

Figure 6:
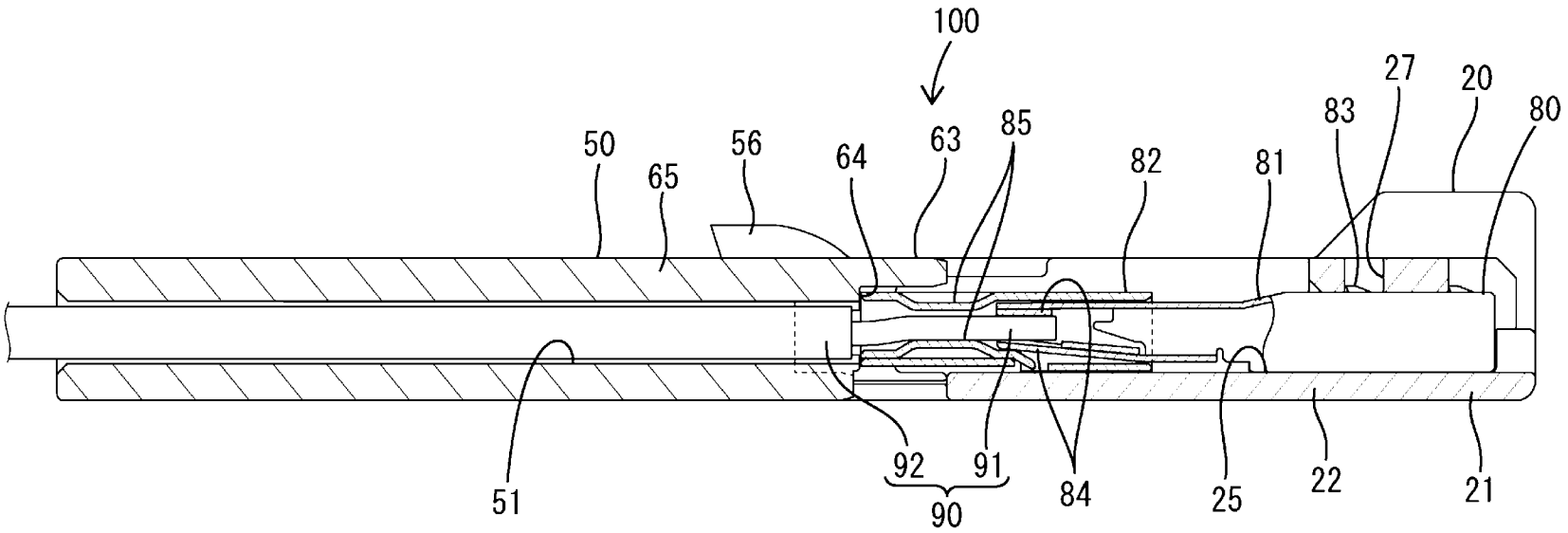
FIG. 6 is a side view in section showing a state where a wire is inserted into an insertion hole and a core exposed in a tip part of the wire is arranged in a terminal when the rear holder is at the partial locking position with respect to the housing.

As shown in FIG. 6, a pressing surface 64 along the vertical direction is provided between the lower surface of the covering wall 63 and the upper surface of the inner wall of the insertion hole 51. The pressing surface 64 serves as a surface for pressing a later-described slide portion 82 of the terminal 80 forward.

As shown in FIG. 4, the rear holder 50 includes guide portions 66 in the form of flat projections extending in the front-rear direction from the body portion 65 to covering wall 63 on the inner surfaces 61 of the recesses 58. The guide portions 66 are provided on both widthwise end sides of the rear holder 50. The recess 58 and the guide portion 66 constitute a holder-side engaging portion 67.

As shown in FIG. 10, the guide portion 66 has a convex wall surface 68 arranged along the vertical direction and front-rear direction on a tip side in a projecting direction in a part of the inner surface 61 of the recess 58 except both upper and lower end parts, and has a pair of convex side surfaces 69 arranged along the lateral direction and front-rear direction on both end sides in the height direction. As shown in FIG. 4, a front end part of the concave wall surface 68 is cut by the cut portion 59.

As shown in FIG. 11, a convex wall surface 68 of the covering wall 63 is connected to an upper end part of the convex wall surface 68 of the body portion 65 without any step. Similarly, the upper convex side surface 69 of the body portion 65 is connected to an upper convex side surface 69 of the covering wall 63 without any step. As shown in FIG. 4, a lower convex side surface 69 of the covering wall 63 constitutes the upper edge of the cut portion 59.

The rear holder 50 includes a plurality of recesses 71 arranged in the width direction in the lower surface of the covering wall 63. Each recess 71 is in the form of a groove extending in the front-rear direction in the inner surface of the covering wall 63 and the front end thereof is open in the front end of the covering wall 63. As shown in FIG. 11, an upper end part of the partition wall 24 of the housing body 21 is fit into the recess 71 of the covering wall 63.

As shown in FIG. 4, the rear holder 50 includes a plurality of rib-like lock portions 72, 73 on the convex wall surfaces 68 of the body portion 65. Each lock portion is composed of a first lock portion 72 and a second lock portion 73 located behind the first lock portion 72.

The rear holder 50 is assembled with the housing 20 movably in the front-rear direction between the partial locking position and the full locking position. When the rear holder 50 is at the partial locking position, the first lock portions 72 are inserted in the lock receiving portions 36 and arranged to be lockable to the retaining edges 37 and the second lock portions 73 are arranged to be lockable to the restricting edges 38. In this way, the rear holder 50 is held at the partial locking position with movements restricted. When the rear holder 50 is at the full locking position, the first lock portions 72 are on front end sides in the lock receiving portions 36 and the second lock portions 73 are inserted on rear end sides in the lock receiving portions 36 (see FIG. 9). In this way, the rear holder 50 is held at the full locking position with movements restricted.

<Terminals and Wires>

The terminal 80 is made of metal and includes, as shown in FIG. 6, a terminal body 81 and the slide portion 82 assembled with the terminal body 81 movably in the front-rear direction. The terminal body 81 is in the form of a rectangular tube and includes the locking portion 83 projecting on an upper surface and to be fit into the locking hole 27. The terminal body 81 includes a pair of connection pieces 84 vertically facing each other in a rear end part. The respective connection pieces 84 are resiliently deformable between an initial position (see FIG. 6) and a connection position (see FIG. 1) where the connection pieces 84 are closer to each other than at the initial position. The slide portion 82 is arranged to cover a rear end part of the terminal body 81. The slide portion 82 includes a pair of contact portions 85 on walls vertically facing each other. When the slide portion 82 is properly assembled with the terminal body 81, the respective contact portions 85 contact the respective connection pieces 84 to displace the respective connection pieces 84 from the initial position to the connection position.

The wire 90 is such a coated wire that the outer periphery of a core 91 is surrounded by a coating 92. In a tip part of the wire 90, the core 91 is exposed by removing the coating 92. The core 91 exposed in the tip part of the wire 90 is inserted into between the respective connection pieces 84 at the initial position (see FIG. 6) and electrically connected to the respective connection pieces 84 at the connection position (see FIG. 1).

<Assembling Method and Functions of Connector>

First, the terminals 80 are inserted and accommodated into the cavities 25 of the housing 20. Subsequently, the rear holder 50 is assembled with the housing 20 from behind. In an assembling process of the rear holder 50, the projecting portions 29 are fit into the recesses 58 from front of the recesses 58 and the guide portions 66 are fit into the guide receiving portions 32 from behind the guide receiving portions 32. In this way, the assembling of the rear holder 50 is guided.

Figure 5:
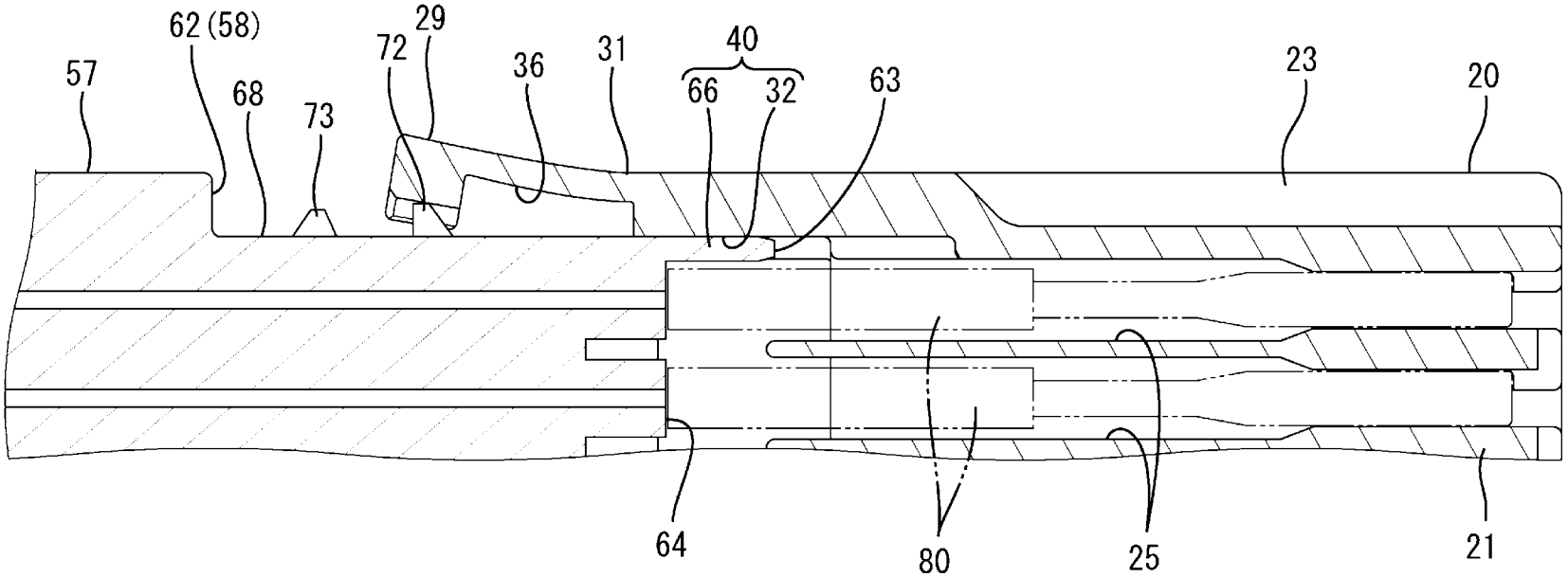
FIG. 5 is a partial enlarged plan view in section showing a state where a guide portion and a guide receiving portion are fit in a front fitting region when a projecting portion interferes with a first lock portion to be deflected and deformed in the process of moving the rear holder to a partial locking position.

As the assembling of the rear holder 50 progresses, the rear end parts of the projecting portions 29 interfere with the first lock portions 72 and the projecting portions 29 are deflected and deformed with the fulcrum portions 31 as fulcrums as shown in FIG. 5. At this time, the guide receiving portions 32 of the projecting portions 29 and the guide portions 66 of the covering wall 63 form front fitting regions 40, which are regions where the guide receiving portions 32 and the guide portions 66 are fit to each other, on a side forward of the fulcrum portions 31. Thus, even if the projecting portions 29 are deflected and deformed, the fitting of the guide portions 66 and the guide receiving portions 32 can be maintained and an assembling operation of the rear holder 50 can smoothly proceed.

When the rear end parts of the projecting portions 29 ride over the first lock portions 72, the projecting portions 29 resiliently return and the first lock portions 72 enter the lock receiving portions 36. In this way, the rear holder 50 is held at the partial locking position with respect to the housing 20. At the partial locking position, the respective insertion holes 51 of the rear holder 50 and the respective cavities 25 of the housing 20 are arranged to communicate in the front-rear direction.

When the rear holder 50 is at the partial locking position, the respective convex side surfaces 69 of the guide portions 66 are contactably facing the respective concave side surfaces 35 of the guide receiving portions 32 as shown in FIGS. 10 and 11. In this way, a displacement of the rear holder 50 in the height direction with respect to the housing 20 is restricted. Further, on both widthwise end sides of the rear holder 50, the convex wall surfaces 68 of the guide portions 66 are contactably facing the concave wall surfaces 35 of the guide receiving portions 32. In this way, a displacement of the rear holder 50 in the width direction with respect to the housing 20 is restricted. Further, as shown in FIG. 11, the upper end parts of the respective partition walls 24 are fit into the respective recesses 71 of the covering wall 63, whereby the displacement of the rear holder 50 in the width direction with respect to the housing 20 is more satisfactorily restricted.

As just described, when the rear holder 50 is at the partial locking position, displacements of the rear holder 50 in the width direction and height direction with respect to the housing 20 are restricted, with the result that the respective insertion holes 51 of the rear holder 50 and the respective cavities 25 of the housing 20 are coaxially and accurately positioned to communicate in the front-rear direction.

Subsequently, the wire 90 is inserted into each insertion hole 51 of the rear holder 50 from behind. The tip part (exposed core 91) of the wire 90 moves from the insertion hole 51 toward the cavity 25 and is, as shown in FIG. 6, inserted into the terminal 80 and arranged between the respective connection pieces 84 of the terminal body 81. Since the insertion hole 51 and the cavity 25 are coaxially and accurately positioned as described above, the tip part of the wire 90 can smoothly move from the insertion hole 51 toward the cavity 25.

Figure 7:
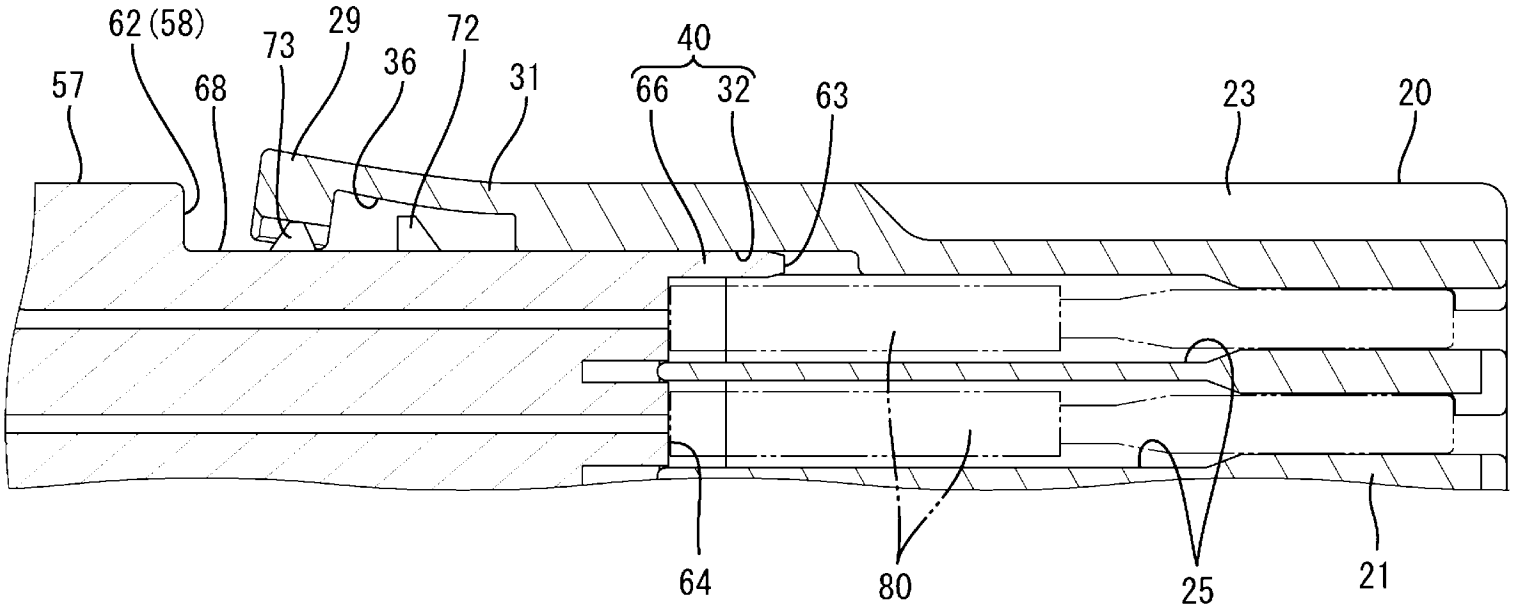
FIG. 7 is a partial enlarged plan view in section showing a state where the guide portion and the guide receiving portion are fit in the front fitting region when the projecting portion interferes with a second lock portion to be deflected and deformed in the process of moving the rear holder from the partial locking position to a full locking position.

Subsequently, the rear holder 50 at the partial locking position is pushed to the full locking position with respect to the housing 20. In the process of moving the rear holder 50 to the full locking position, the rear end parts of the projecting portions 29 interfere with the second lock portions 73 and the projecting portions 29 are deflected and deformed with the fulcrum portions 31 as fulcrums as shown in FIG. 7. Also at this time, the fit state of guide receiving portions 32 and the guide portions 66 can be maintained in the front fitting regions 40. Thus, the rear holder 50 can be smoothly moved to the full locking position.

Figure 2:
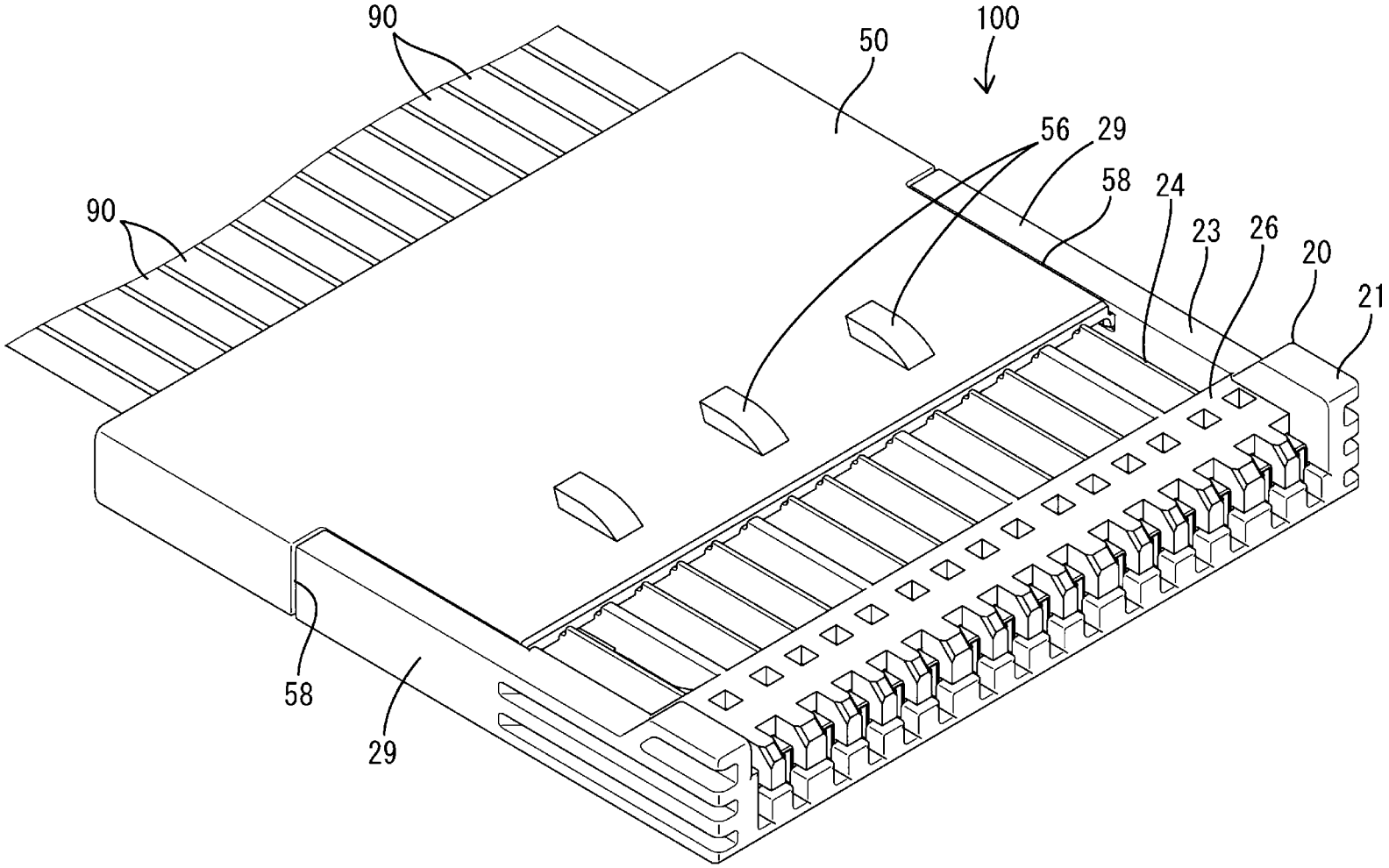
FIG. 2 is a perspective view of the subunit.

When the rear end parts of the projecting portions 29 ride over the second lock portions 73, the projecting portions 29 resiliently return and, as show in FIGS. 8 and 9, the second lock portions 73 enter the lock receiving portions 36. In this way, the rear holder 50 is held at the full locking position with respect to the housing 20. When the rear holder 50 is at the full locking position, the projecting portions 29 are entirely fit in the recesses 58 and confined within the outer shape of the rear holder 50 as shown in FIG. 2.

Further, in the process of moving the rear holder 50 to the full locking position, the pressing surfaces 64 of the rear holder 50 press the slide portions 82 and the slide portions 82 slide with respect to the terminal bodies 81. During this time, the respective contact portions 85 of the slide portion 82 contact the respective connection pieces 84 of the terminal body 81 and the respective connection pieces 84 are displaced toward the connection position. When the respective connection pieces 84 reach the connection position, the core 91 exposed in the tip part of the wire 90 is sandwiched by the respective connection pieces 84 and electrically connected (see FIG. 1). This terminal 80 has no crimping structure such as a barrel portion. Thus, the terminal 80 can be reduced in size and, consequently, the connector 10 can be reduced in size.

As shown in FIG. 1, the subunit 100 assembled through the above steps is accommodated into the main housing 200. The subunit 100 is inserted into a unit accommodating portion 202 of the main housing 200 and retained and locked by the locking lances 201. Thereafter, the main housing 200 is connected to the unillustrated mating housing, whereby unillustrated mating terminals accommodated in the mating housing are inserted into the terminal bodies 81 and the terminals 80 and the mating terminals are electrically connected.

As described above, according to the first embodiment, the guide portions 66 and the guide receiving portions 32 are fit with the recesses 58 of the holder-side engaging portions 67 covered by the projecting portions 29 of the housing-side engaging portions 33. Thus, a displacement of the rear holder 50 with respect to the housing 20 can be suppressed and the respective insertion holes 51 of the rear holder 50 and the respective cavities 25 of the housing 20 can be allowed to coaxially and accurately communicate. As a result, an operation of inserting the wires 90 into the terminals 80 can be smoothly performed and the connector 10 can be efficiently assembled.

The projecting portions 29 of the housing-side engaging portions 33 are shaped to project forward from the side walls 23 and the recesses 58 of the holder-side engaging portions 67 are shaped to be concave in the side surfaces 57 of the rear holder 50. Thus, the enlargement of the housing 20 and the rear holder 50 in the width direction can be avoided.

Further, the projecting portions 29 of the housing-side engaging portions 33 are provided with the lock receiving portions 36 in addition to the guide receiving portions 32, and the recesses 58 of the holder-side engaging portions 67 are provided with the lock portions 72, 73 in addition to the guide portions 66. Thus, the structure of the connector 10 can be simplified as compared to the case where the lock receiving portions 36 are provided on parts other than the projecting portions 29 and the lock portions 72, 73 are provided on paths other than the recesses 58.

On the other hand, if the projecting portions 29 are deflected and deformed with the fulcrum portions 31 as fulcrums when the lock portions 72, 73 and the lock receiving portions 36 interfere with each other, the guide portions 66 and the guide receiving portions 32 may be disengaged. However, according to the first embodiment, the fitting of the guide portions 66 and the guide receiving portions 32 can be maintained by the front fitting regions 40 formed forward of the fulcrum portions 31.

Further, since the upper end parts of the partition walls 32 are fit into the recesses 71 of the covering wall 63, relative displacements of the covering wall 63 and the partition walls 24 can be suppressed.

Second Embodiment

Figure 12:
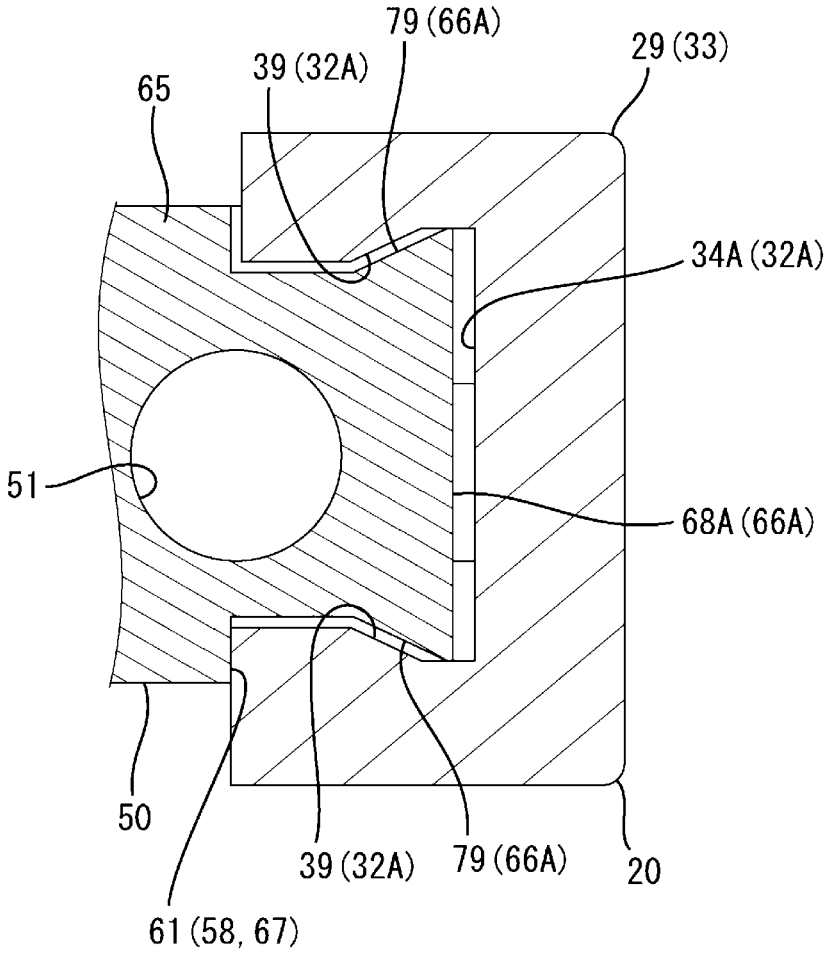
FIG. 12 is a partial enlarged transverse section showing a state where a guide portion and a guide receiving portion are fit in a connector according to a second embodiment.

Next, a second embodiment of the present disclosure is described using FIG. 12. The second embodiment differs from the first embodiment in the structures of guide portions 66A and guide receiving portions 32A. Since other components are similar to those of the first embodiment, repeated description is omitted.

The guide receiving portions 32A are so open in the inner surfaces of projecting portions 29 of housing-side engaging portions 33 on both widthwise end sides of the housing 20 as to be widened toward a back side from a narrow entrance side. Specifically, the guide receiving portion 32A has a concave wall surface 34A arranged along a vertical direction and a front-rear direction on a back side in a concave direction in a part of the inner surface of the projecting portion 29 except both upper and lower end parts, and has dovetail groove surfaces 39 inclined to be widened in a height direction toward the back side in the concave direction on both end sides in the height direction.

The guide portions 66A project on inner surfaces 61 of recesses 58 of holder-side engaging portions 67 in such a manner as to be widened toward a tip side from a narrow base end side on both widthwise end sides of the rear holder 50. Specifically, the guide portion 66A has a convex wall surface 68A arranged along the vertical direction and front-rear direction toward the tip side in a projecting direction in a part of the inner surface 61 of the recess 58 except both upper and lower end parts, and has dovetail surfaces 79 inclined to be widened in the height direction toward the tip side in the projecting direction on both end sides in the height direction.

When a rear holder 50 is assembled with a housing 20, the guide portions 66A and the guide receiving portions 32A are fit and the dovetail surfaces 79 of the guide portions 66A and the dovetail groove surfaces 39 of the guide receiving portions 32A are contactably facing each other along a direction intersecting the vertical direction and lateral direction. In this way, displacements of the rear holder 50 in the height direction and width direction with respect to the housing 20 are more satisfactorily suppressed. As a result, accuracy in coaxially positioning insertion holes 51 and cavities 25 can be further enhanced.

Other Embodiments of Present Disclosure

The first and second embodiments disclosed this time should be considered illustrative in all aspects, rather than restrictive.

Although the housing-side engaging portion is shaped to cover the holder-side engaging portion from outside in the case of the first and second embodiments, the holder-side engaging portion may be shaped to cover the housing-side engaging portion from outside as another embodiment, contrary to the first and second embodiments. For example, contrary to the first and second embodiments, the holder-side engaging portion may include a projecting portion and the housing-side engaging portion may include a recess.

Although the projection-like guide portion is formed in the recess and the recess-like guide receiving portion is formed in the projecting portion in the case of the first and second embodiments, a recess-like guide portion may be formed in the recess and a projection-like guide receiving portion may be formed on the projecting portion as another embodiment, contrary to the first and second embodiments.

Although the recesses are provided in the side surfaces of the rear holder in the case of the first and second embodiments, the recesses may not be provided in the side surfaces of the rear holders as another embodiment.

Although the lock portion includes the first and second lock portions in the case of the first embodiment, the lock portion may be composed of a single lock portion as another embodiment.

Although the rear holder is structured to press the slide portions and slide the slide portions with respect to the terminal bodies in the process of moving toward the full locking position in the case of the first embodiment, the rear holder may not be provided with the function of pressing the slide portions as another embodiment. The rear holder only has to have a structure capable of restricting the escape of the terminals from the housing. Note that the terminals may be structured to be crimped and connected to the end parts of the wires.

Although the concave wall surface and the dovetail groove surfaces are provided on the inner surface side of the projecting portion and the convex wall surface and the dovetail surfaces are provided on the inner surface side of the recess in the case of the second embodiment, the concave wall surface and the dovetail groove surfaces may be provided on the inner surface side of the side wall and the convex wall surface and the dovetail surfaces may be provided on both end sides in the width direction of the covering wall as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing;

a rear holder to be arranged on a rear part of the housing; and terminals to be accommodated into the housing, wherein:

the housing includes a plurality of cavities arranged in a width direction and housing-side engaging portions provided on both end sides in the width direction, the rear holder includes a plurality of insertion holes arranged in the width direction and communicating with the cavities, and holder-side engaging portions provided on both end sides in the width direction to contact the housing-side engaging portions, the terminals are connected to wires arranged from the insertion holes to the cavities, one of the housing-side engaging portion and the holder-side engaging portion is arranged to cover the other from outside, a guide receiving portion extending in a front-rear direction is provided on an inner surface of the one engaging portion and a guide portion extending in the front-rear direction and to be fit to the guide receiving portion is provided on an outer surface of the other engaging portion, the housing has side walls on both end sides in the width direction and the housing-side engaging portion serving as the one engaging portion includes a projecting portion projecting rearward from the side wall, the rear holder has side surfaces on both end sides in the width direction and the holder-side engaging portion serving as the other engaging portion includes a recess open forward to receive the housing-side engaging portion in the side surface, and a concave lock receiving portion is provided on an inner surface of the projecting portion and is open in a lower end of the projecting portion and closed by an outer surface side of the projecting portion and a rib-like lock portion to be locked to the lock receiving portion is provided on an inner surface of the recess.

2. The connector of claim 1, wherein:

the projecting portion is deflectable and deformable with a fulcrum portion as a fulcrum, and the guide receiving portion and the guide portion are fit to configure a front fitting region forward of the fulcrum portion.

3. The connector of claim 1, wherein:

the guide receiving portion is in the form of a groove recessed in the inner surface of the one engaging portion and having a back end side enlarged in a height direction, and the guide portion is in the form of a projection projecting from the outer surface of the other engaging portion and having a tip side enlarged in the height direction.

4. The connector of claim 1, wherein:

the housing includes partition walls partitioning between the cavities adjacent in the width direction and the rear holder includes a covering wall for covering rear openings of the cavities at positions facing end parts of the partition walls, and the covering wall includes recesses to be fit to the end parts of the partition walls.

* * * * *